US010435931B2

(12) United States Patent
Su et al.

(10) Patent No.: US 10,435,931 B2
(45) Date of Patent: Oct. 8, 2019

(54) DOOR CLOSER DEVICE

(71) Applicant: ARCTEK INDUSTRIAL CO., LTD., Changhua County (TW)

(72) Inventors: Wen-Yuan Su, Changhua County (TW); Jia-Yu Chen, Changhua County (TW)

(73) Assignee: ARCTEK INDUSTRIAL CO., LTD., Changhua County (TW)

( * ) Notice: Subject to any disclaimer, the term of this patent is extended or adjusted under 35 U.S.C. 154(b) by 75 days.

(21) Appl. No.: 15/592,308

(22) Filed: May 11, 2017

(65) Prior Publication Data

US 2018/0058126 A1 Mar. 1, 2018

(30) Foreign Application Priority Data

Aug. 25, 2016 (TW) ..... 105127232 A
Dec. 14, 2016 (TW) ..... 105141414 A
Mar. 10, 2017 (TW) ..... 106108060 A

(51) Int. Cl.
*E05D 7/04* (2006.01)
*E05F 3/22* (2006.01)
(Continued)

(52) U.S. Cl.
CPC ..... *E05D 7/0415* (2013.01); *E05D 5/0246* (2013.01); *E05D 7/04* (2013.01);
(Continued)

(58) Field of Classification Search
CPC ..... E05D 7/04; E05D 7/0415; E05F 7/005; E05F 3/226
See application file for complete search history.

(56) References Cited

U.S. PATENT DOCUMENTS 3,101,507 A * 8/1963 Cecala ..... E05D 7/081 16/241
3,646,635 A * 3/1972 Stermac ..... E05D 7/04 16/239
(Continued)

FOREIGN PATENT DOCUMENTS

AU 12123/83 A 9/1983
CN 2895652 Y 5/2007
(Continued)

OTHER PUBLICATIONS

European Search Report dated Nov. 16, 2017 for European Patent Application No. 17170942.1, 14 pages.
(Continued)

*Primary Examiner* — Jeffrey O'Brien
(74) *Attorney, Agent, or Firm* — Jackson IPG PLLC; Demian K. Jackson

(57) ABSTRACT

A door closer device for driving a door to a predetermined closed position includes an adjustment mechanism and a door closer which is integrated with the door. The adjustment mechanism includes a base, an adjusting plate and at least one fixing element, wherein the adjusting plate is stacked with the base and coupled with the door closer. The adjusting plate and the base respectively include at least one adjusting bore, and the adjusting bores are corresponding with each other. One of the adjusting bores includes a first limiting end and a second limiting end, and a first moving path is defined between the first and second limiting ends. The fixing element is disposed in the adjusting bores and can move along the first moving path to fix the adjusting plate on the base.

7 Claims, 18 Drawing Sheets

(51) Int. Cl.
*E05F 1/12* (2006.01)
*E05D 5/02* (2006.01)
*E05D 7/081* (2006.01)

(52) U.S. Cl.
CPC ..... *E05D 7/081* (2013.01); *E05F 1/1253* (2013.01); *E05F 3/226* (2013.01); *E05D 2007/0461* (2013.01); *E05Y 2600/626* (2013.01); *E05Y 2900/132* (2013.01)

(56) References Cited

U.S. PATENT DOCUMENTS 4,142,271 A * 3/1979 Busse ..... E05D 5/0276 16/238
4,999,876 A * 3/1991 Nass ..... E05D 7/04 16/236
5,689,855 A * 11/1997 Tang ..... E05D 7/0054 16/235
6,145,164 A * 11/2000 Ferrari ..... E05D 7/0407 16/235
6,202,255 B1 * 3/2001 Sitter ..... E05D 7/0415 16/239
6,609,335 B1 * 8/2003 Hyakkoku ..... E05D 7/0415 49/388
7,017,231 B2 * 3/2006 Isele ..... E05D 7/0407 16/236
7,350,272 B2 * 4/2008 Fries ..... E05D 7/02 16/236
9,605,457 B2 * 3/2017 Humble ..... E05D 7/04
9,644,411 B2 * 5/2017 Gompper ..... E05D 7/0054
2001/0025396 A1 * 10/2001 Sitter ..... E05D 7/04 16/221
2004/0068840 A1 * 4/2004 Thomas ..... E05D 7/0415 16/245
2004/0163211 A1 * 8/2004 Rucker ..... E05D 7/0415 16/235
2006/0137139 A1 * 6/2006 Wu ..... E05D 7/0415 16/236
2007/0136988 A1 * 6/2007 Bullock ..... E05D 7/0415 16/245
2008/0016648 A1 * 1/2008 Lautenschlager ..... E05D 7/0415 16/238
2008/0307606 A1 * 12/2008 Karlsson ..... E05D 7/0415 16/243
2014/0215923 A1 * 8/2014 Gompper ..... E05D 7/0054 49/381
2014/0359973 A1 * 12/2014 Ng ..... E05D 7/00 16/225
2016/0208532 A1 7/2016 Humble
2017/0260784 A1 * 9/2017 Laird ..... F16B 2/185

FOREIGN PATENT DOCUMENTS

CN 204266752 U 4/2015
DE 2427114 A1 12/1975
EP 0255886 A2 2/1988
GB 854864 11/1960
JP 2006-194079 A 7/2006
KR 10-0829964 B1 5/2008

OTHER PUBLICATIONS

Australian Office Action dated Mar. 16, 2018 for Australian Patent Application No. 2017203198, 4 pages.
Korean Office Action dated Jul. 19, 2018 for Korean Patent Application No. 10-2017-0054215, 7 pages.
Taiwanese Office Action dated Dec. 28, 2018 for Taiwanese Patent Application No. 106108060, 7 pages.
Chinese Office Action dated Dec. 3, 2018 for Chinese Patent Application No. 201710258178.X, 12 pages.
Indian Examination report dated Jun. 13, 2019 for Indian Patent Application No. 201724017115, 7 pages.

* cited by examiner

DOOR CLOSER DEVICE

FIELD OF THE INVENTION

This invention relates to an adjustment mechanism of door closer device, and more particularly relates to an adjustment mechanism which can allow a door to be mounted at a predetermined closed position by adjusting an adjusting plate's relative coupling position.

BACKGROUND OF THE INVENTION

A conventional door is pivotally integrated with a doorframe by a hinge for open and close. The door installer needs to detach the hinge and install again if the door can not close at a predetermined closed position, but the door or the doorframe may be damaged during reinstallation.

Before installation, the door installer needs to compare and measure the installation position of the hinge relative to the door or the doorframe over and over again for preventing the door from not closing at the predetermined closed position, and then drills a bore to install the hinge precisely. Hence time required for door installation will be increased.

SUMMARY

The primary object of an adjustment mechanism of door closer device of the present invention is adapted for allowing a door to swing to a predetermined closed position precisely.

The adjustment mechanism of door closer device of the present application comprises a base including at least one adjusting bore; an adjusting plate including at least one adjusting bore, wherein the adjusting plate is stacked with the base, and the adjusting bore of the adjusting plate is corresponding with the adjusting bore of the base, and wherein one of the adjusting bores includes a first limiting end and a second limiting end, and a first moving path is defined between the first and second limiting ends; and at least one fixing element disposed in the adjusting bores of the adjusting plate and the base, wherein the fixing element moves along the first moving path to fix the adjusting plate on the base.

The adjustment mechanism of door closer device of the present application comprises a base; an adjusting plate including a plurality of tapped holes, wherein the adjusting plate is stacked with the base; and a plurality of adjusting screws, wherein each of the adjusting screws is engaged in each of the tapped holes, and a terminal part of each of the adjusting screws contacts with the base to push the adjusting plate for forming a gap between the adjusting plate and the base.

The adjustment mechanism of door closer device of the present application comprises a base including at least one joint bore; an adjusting plate including at least one joint bore, wherein the adjusting plate is stacked with the base, and the joint bore of the adjusting plate is corresponding with the joint bore of the base; and a joint element disposed in the joint bores of the adjusting plate and the base, wherein the joint element includes a first joint portion and a second joint portion which are eccentric.

The adjustment mechanism of door closer device coupled with a door is capable of adjusting the coupling position of the adjusting plate relative to the base and coupling the adjusting plate and the base through the fixing element, to allow the door to swing to a predetermined closed position for closing precisely.

DETAILED DESCRIPTION OF THE INVENTION

Figure 1:
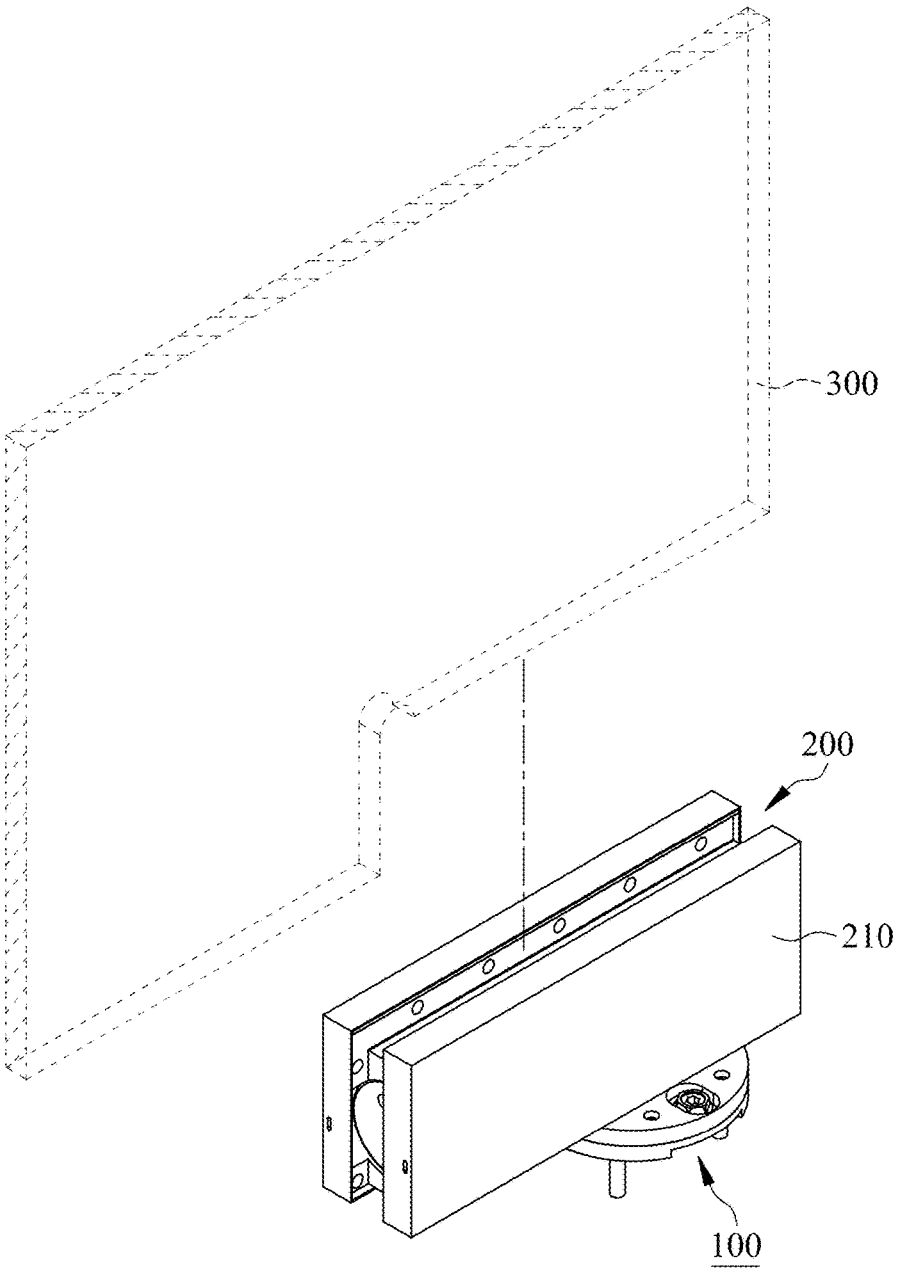
FIG. 1 is a perspective assembly diagram illustrating a door closer device in accordance with one embodiment of the present invention.
Figure 2:
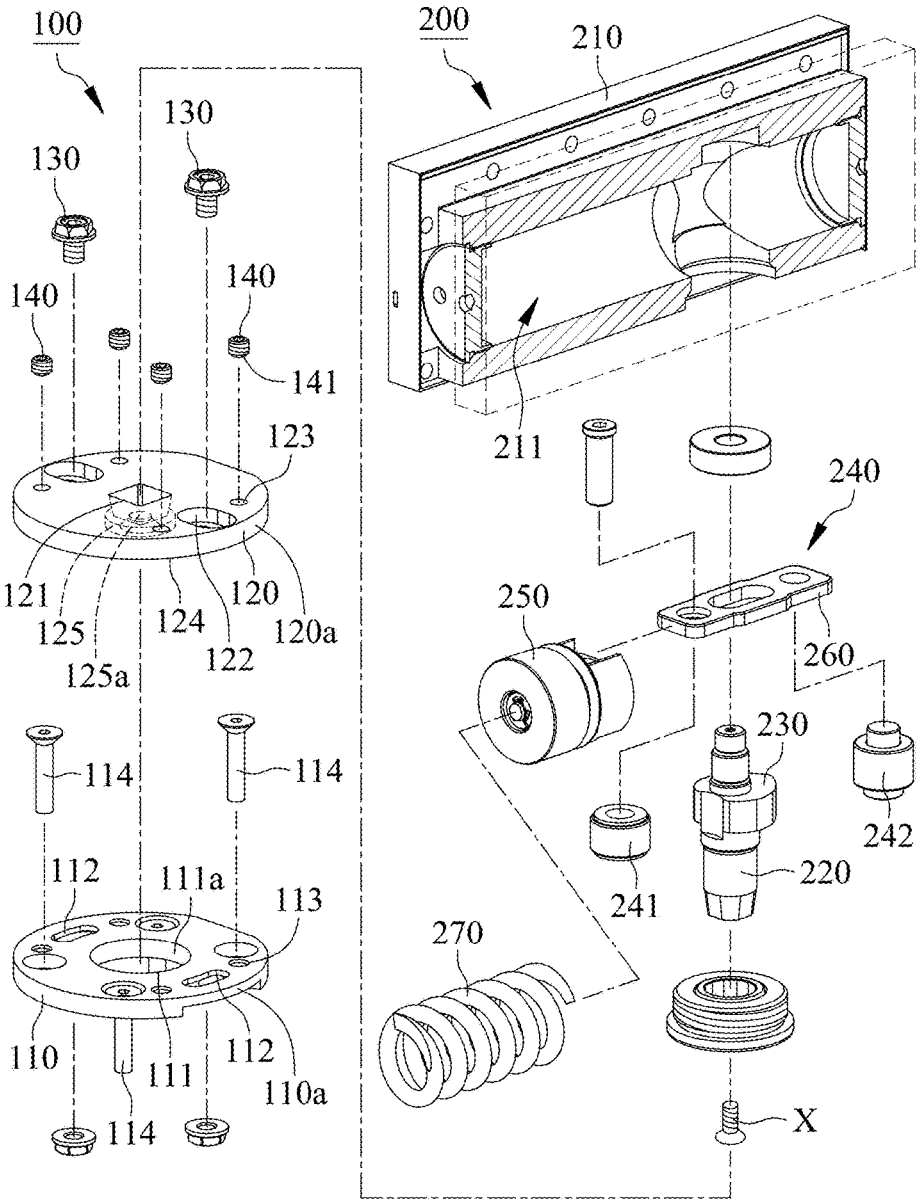
FIG. 2 is a perspective exploded diagram illustrating the door closer device in accordance with a first embodiment of the present invention.

With reference to FIGS. 1 and 2, a door closer device in accordance with a first embodiment of the present invention comprises an adjustment mechanism 100 and a door closer 200. The adjustment mechanism 100 is installed on the ground in the first embodiment, but the adjustment mechanism 100 is not limited to be installed on the ground in the present invention. The door closer 200 is installed on the adjustment mechanism 100 for coupling with a door 300 and allowing the door 300 to swing to a predetermined closed position.

Figure 3:
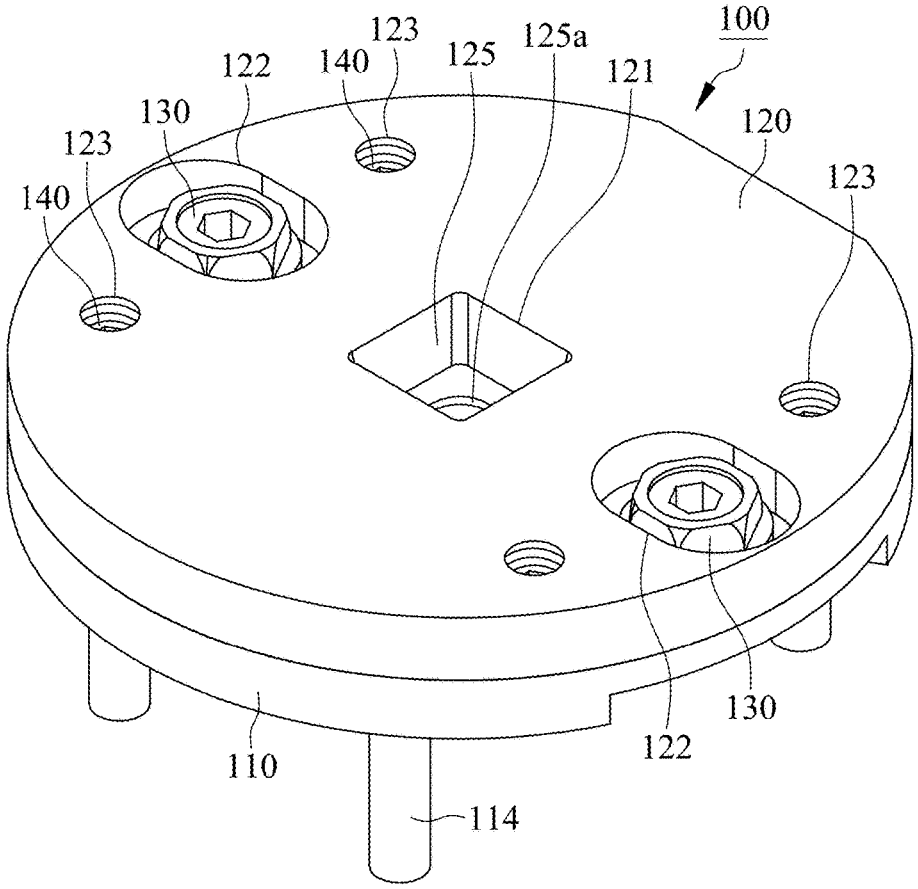
FIG. 3 is a perspective assembly diagram illustrating an adjustment mechanism of the door closer device in accordance with the first embodiment of the present invention.
Figure 4:
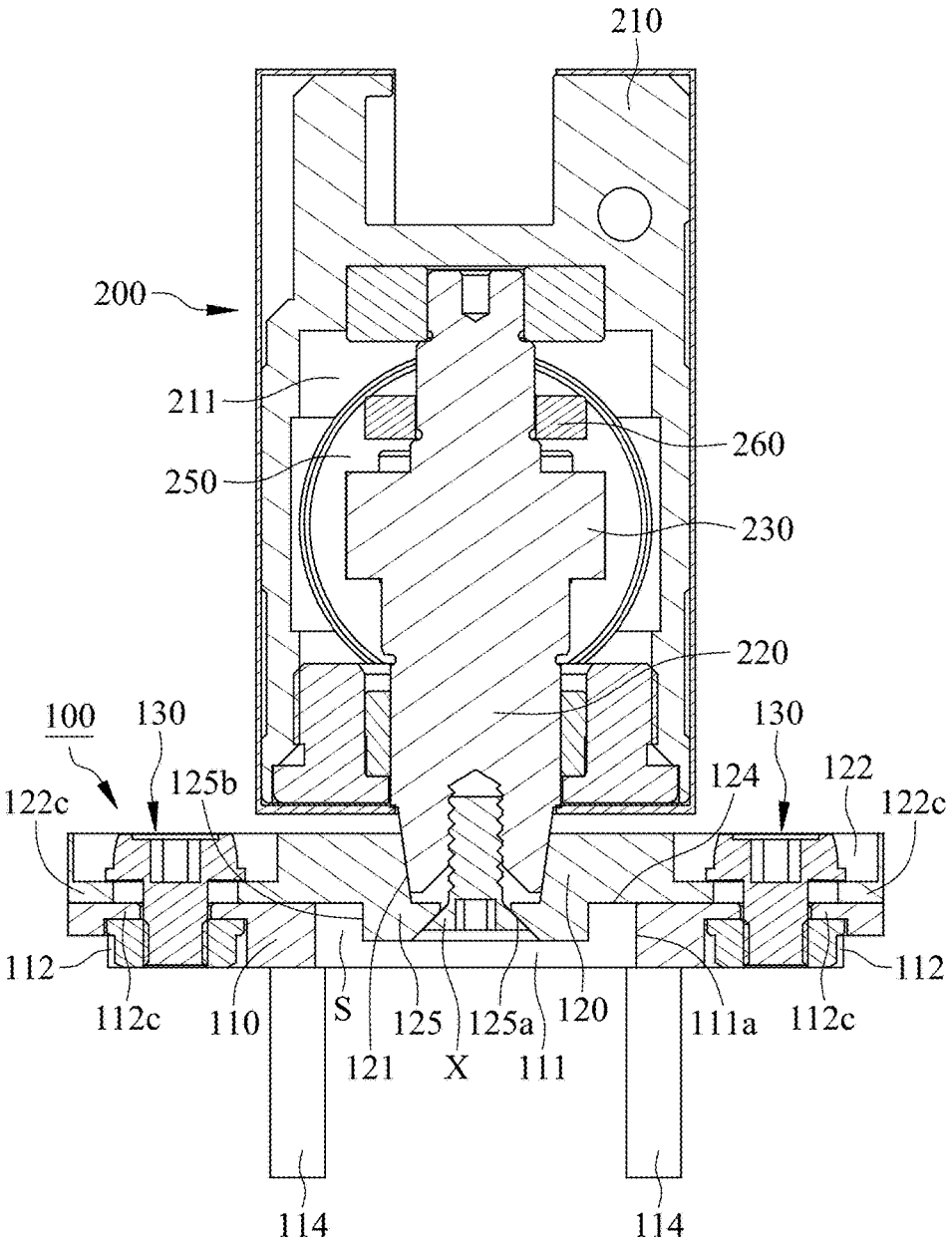
FIG. 4 is a cross-section view diagram illustrating the door closer device in accordance with the first embodiment of the present invention.

With reference to FIGS. 2, 3 and 4, the adjustment mechanism 100 includes a base 110, an adjusting plate 120 and at least one fixing element 130, wherein the adjusting plate 120 is integrated with a rotating shaft 220. In the first embodiment, the rotating shaft 220 is included in the door closer 200.

With reference to FIGS. 2, 3, 4 and 5, the adjusting plate 120 is stacked with the base 110, and the adjusting plate 120 and the base 110 respectively include at least one adjusting bore, wherein the adjusting bores of the adjusting plate 120 and the base 110 are corresponding with each other. The base 110 includes an accommodation part 111 formed as opening hole and at least one first adjusting bore 112, wherein the first adjusting bore 112 is located between the accommodation part 111 and an external edge 110*a* of the base 110. In the first embodiment, the first adjusting bore 112 is a curved counterbore, and a first flange 112*c* is disposed in the first adjusting bore 112. The base 110 further includes a plurality of setting posts 114 for setting the base 110 on the ground.

Figure 5:
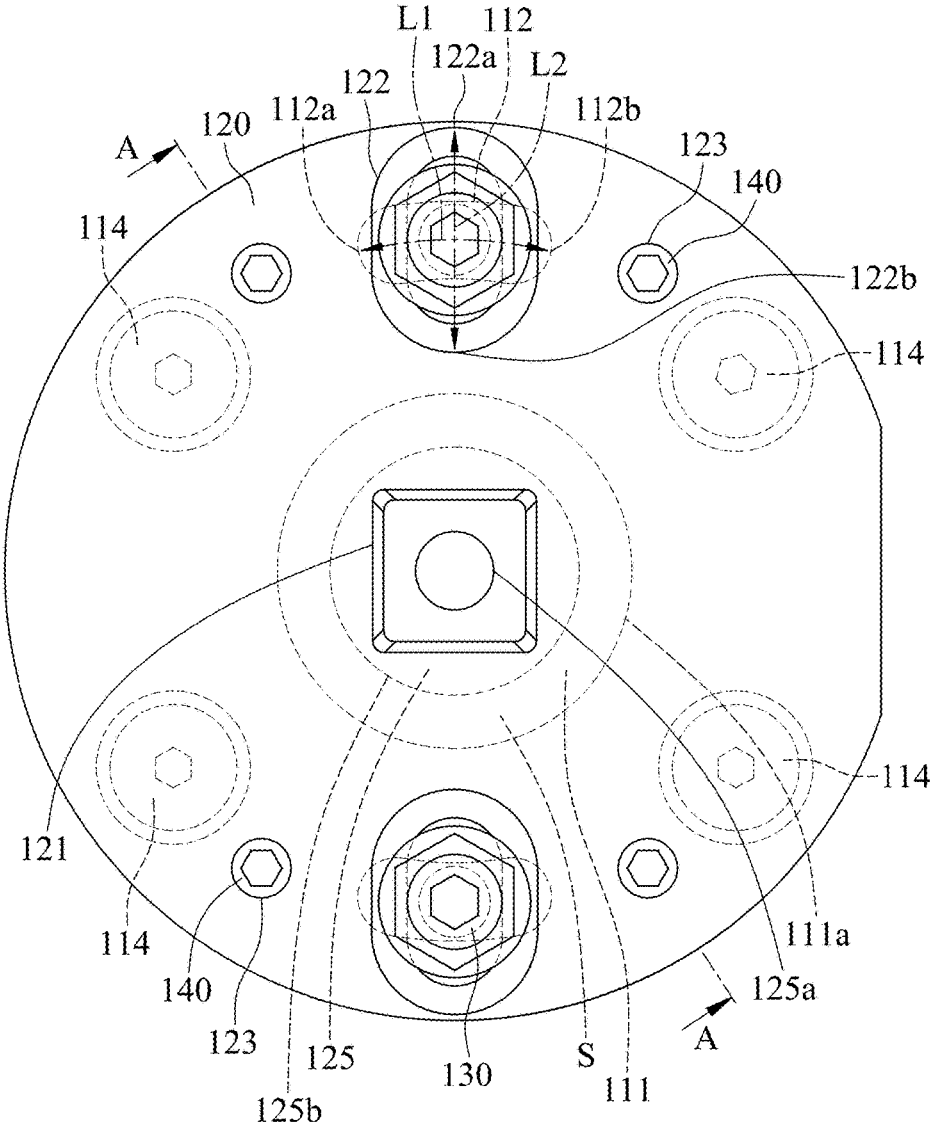
FIG. 5 is a top view diagram illustrating the adjustment mechanism of the door closer device in accordance with the first embodiment of the present invention.

With reference to FIGS. 2 and 5, the first adjusting bore 112 includes a first limiting end 112*a* and a second limiting end 112*b*, and there is a first horizontal moving path L1 defined between the first limiting end 112*a* and the second limiting end 112*b*. In this embodiment, the first horizontal moving path L1 is a curved path.

With reference to FIGS. 2, 3, 4 and 5, the adjusting plate 120 includes an axial bore 121 and at least one second adjusting bore 122 corresponding to the first adjusting bore 112, wherein the second adjusting bore 122 is located above the first adjusting bore 112, and the axial bore 121 is aligned with the accommodation part 111. In the first embodiment, the axial bore 121 is provided for integrating with the rotating shaft 220.

With reference to FIGS. 2, 4 and 5, the rotating shaft 220 is integrated with the adjusting plate 120 via the axial bore 121, and the second adjusting bore 122 is located between the axial bore 121 and an external edge 120*a* of the adjusting plate 120. In the first embodiment, the second adjusting bore 122 is a long counterbore, and a second flange 122*c* is disposed in the second adjusting bore 122. The second adjusting bore 122 includes a third limiting end 122*a* and a fourth limiting end 122*b*, and there is a second horizontal moving path L2 defined between the third limiting end 122*a* and the fourth limiting end 122*b*, wherein the second horizontal moving path L2 is a linear path in the first embodiment. With reference to FIG. 5, the second horizontal moving path L2 and the first horizontal moving path L1 crisscross with each other.

With reference to FIGS. 2, 4 and 5, the adjusting plate 120 further includes a surface 124 and a fixing base 125 in the first embodiment, wherein the surface 124 faces toward the base 110, and the fixing base 125 protrudes from the surface 124. The fixing base 125 includes a through bore 125*a* communicating with the axial bore 121. With reference to FIGS. 4 and 5, the fixing base 125 is accommodated within the accommodation part 111, and preferably, there is a space S between an internal side surface 111*a* of the accommodation part 111 and an external side surface 125*b* of the fixing base 125.

With reference to FIGS. 2, 3 and 4, the fixing element 130 is disposed in the first adjusting bore 112 and the second adjusting bore 122. With reference to FIG. 5, when the adjusting plate 120 is adjusted to a coupling position relative to the base 110, the fixing element 130 is capable of moving along the first horizontal moving path L1 or the second horizontal moving path L2 to a position to couple the base 110 and the adjusting plate 120. Preferably, the fixing element 130 is composed of a screw and a nut which can engage with each other, and the screw head and the nut press on the second flange 122*c* and the first flange 112*c* respectively to couple the base 110 and the adjusting plate 120. In the first embodiment, the installer can position the fixing element 130 along the first horizontal moving path L1 or the second horizontal moving path L2 after moving or rotating the adjusting plate 120, or the installer can move or rotate the adjusting plate 120 to push the fixing element 130 to the position along the first horizontal moving path L1 or the second horizontal moving path L2.

With reference to FIGS. 1, 2, 4 and 6, the door closer 200 is installed on the adjusting plate 120, and in the first embodiment, a fastener X is utilized to fasten the rotating shaft 220 on the fixing base 125 for assembling the rotating shaft 220 and the adjusting plate 120.

Figure 6:
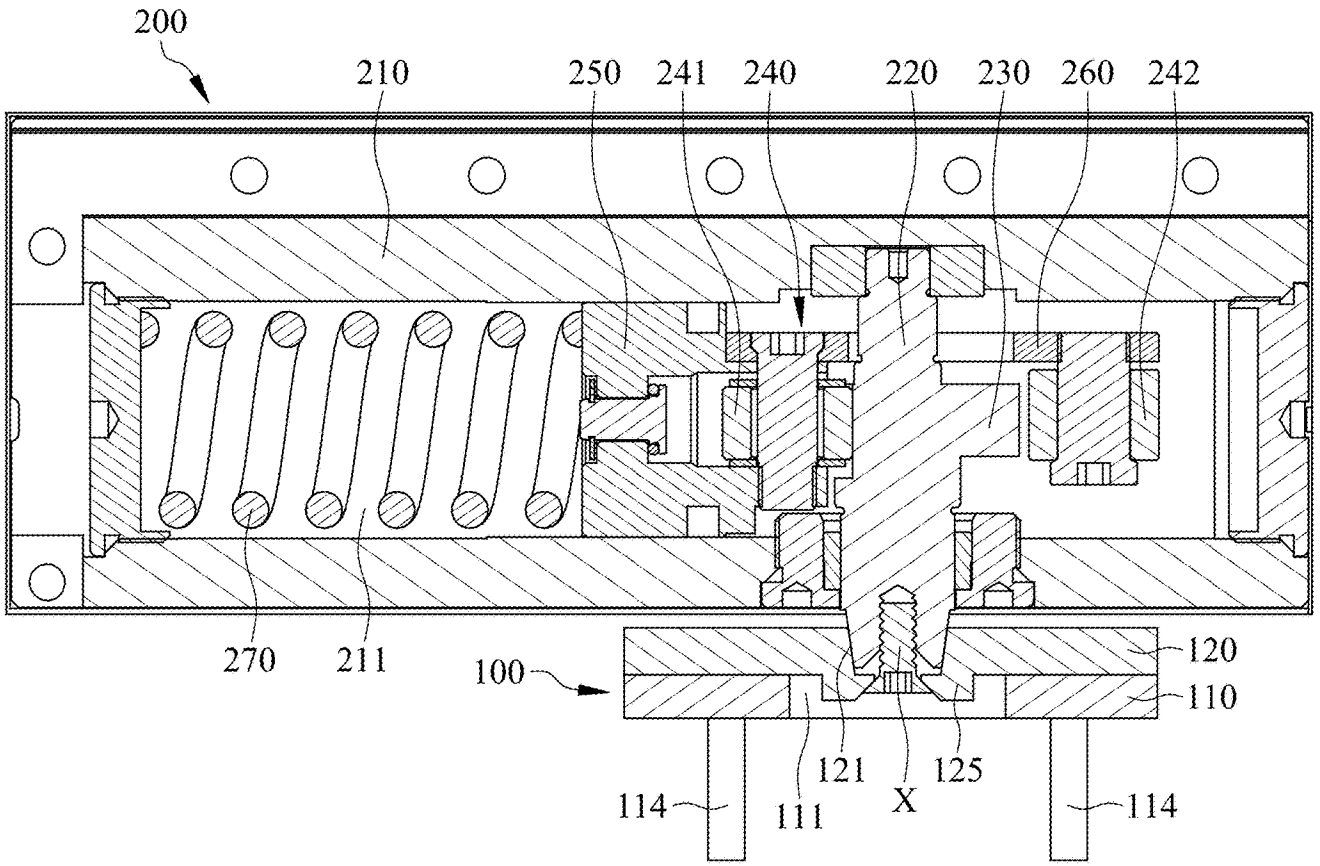
FIG. 6 is a cross-section view diagram illustrating the door closer device in accordance with the first embodiment of the present invention.

With reference to FIGS. 2, 4 and 6, the door closer 200 further includes a case 210, a cam 230, a roller group 240 and a piston 250, wherein the cam 230 is preferably an eccentric cam located on the rotating shaft 220. The cam 230, the roller group 240 and the piston 250 are disposed within an accommodation space 211 of the case 210, wherein the accommodation space 211 is filled with hydraulic oil. The roller group 240 includes a first roller 241 and a second roller 242, wherein the first roller 241 and the second roller 242 are located on both sides of the cam 230 respectively, and the first roller 241 is coupled with the piston 250. In the first embodiment, the door closer 200 further includes a connecting rod 260 which is assembled on the rotating shaft 220, wherein two ends of the connecting rod 260 are coupled with the first roller 241 and the second roller 242 respectively. During opening or closing the door 300, the cam 230 is capable of contacting with the first roller 241 or the second roller 242, and pushing the piston 250 and the hydraulic oil for smoothly opening or closing the door 300. Preferably, the door closer 200 further includes an elastic element 270 which is utilized for pushing the piston 250 to allow the first roller 241 to contact with the cam 230.

Figure 7:
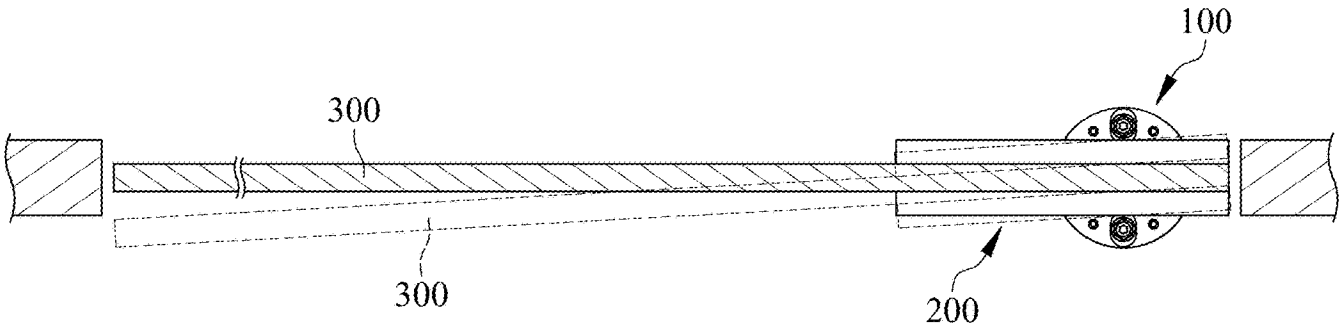
FIG. 7 is a top view diagram illustrating the door closer device coupled to a door in accordance with the first embodiment of the present invention.
Figure 8:
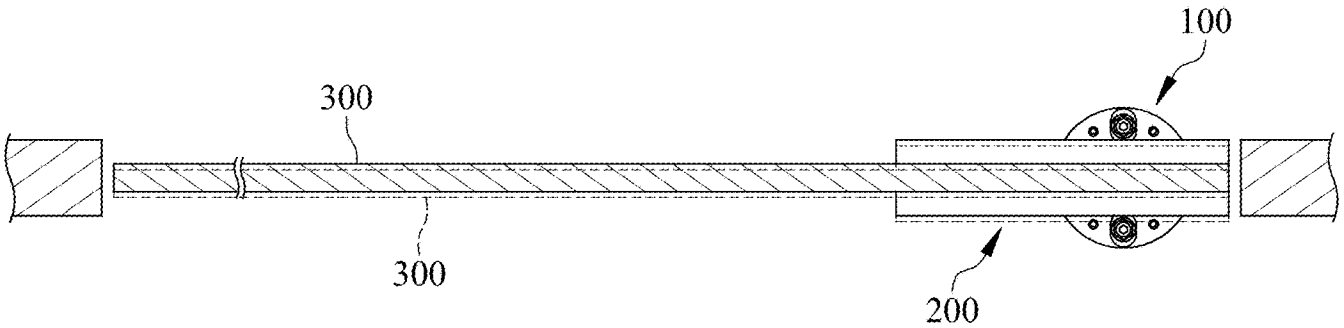
FIG. 8 is a top view diagram illustrating the door closer device coupled to a door in accordance with the first embodiment of the present invention.

With reference to FIGS. 7 and 8, when the door closer 200 can not allow the door 300 to swing to a predetermined closed position (shown as dotted line), the installer can adjust the coupling position of the adjusting plate 120 relative to the base 110 to allow the door 300 to swing to the predetermined closed position (shown as full line).

Figure 9:
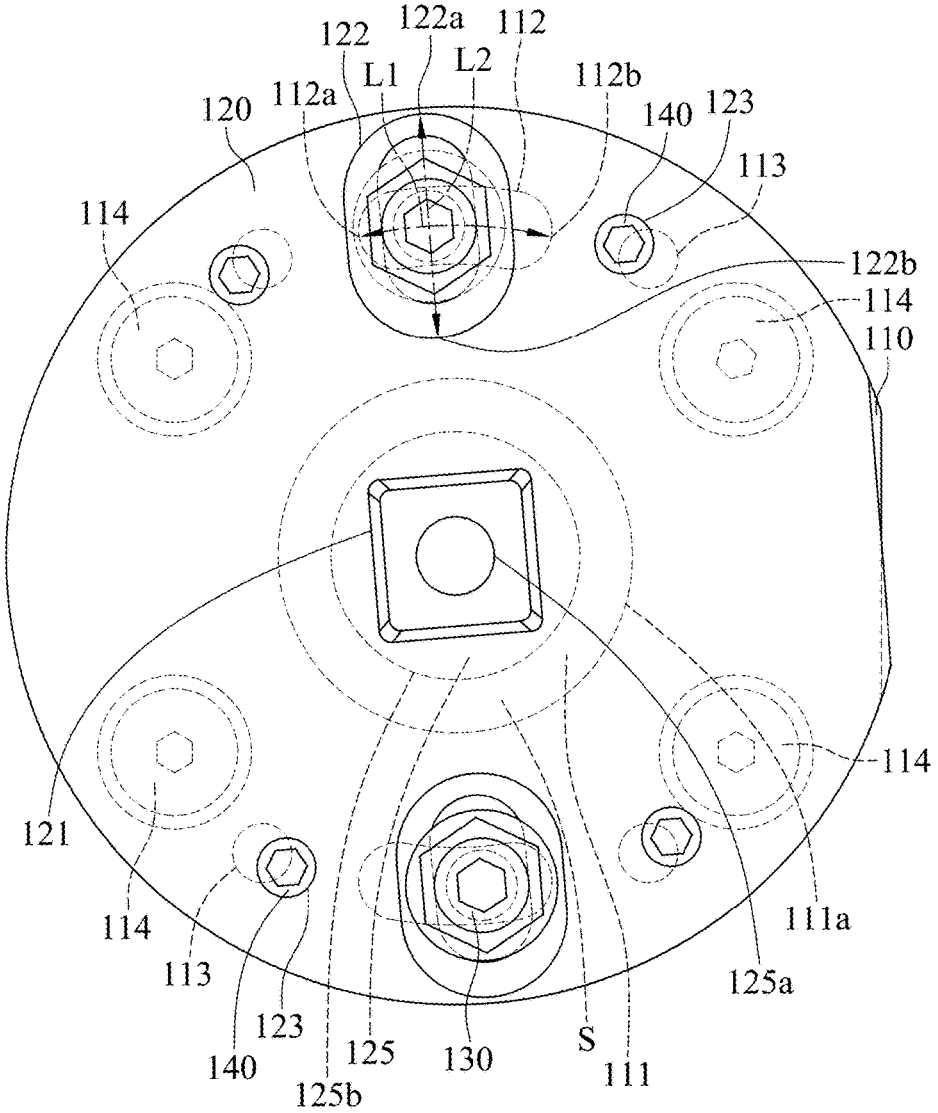
FIGS. 9 and 10 are top view diagrams illustrating an adjusting plate of the adjusting mechanism adjusted to a coupling position relative to a base of the adjustment mechanism in accordance with the first embodiment of the present invention.
Figure 10:
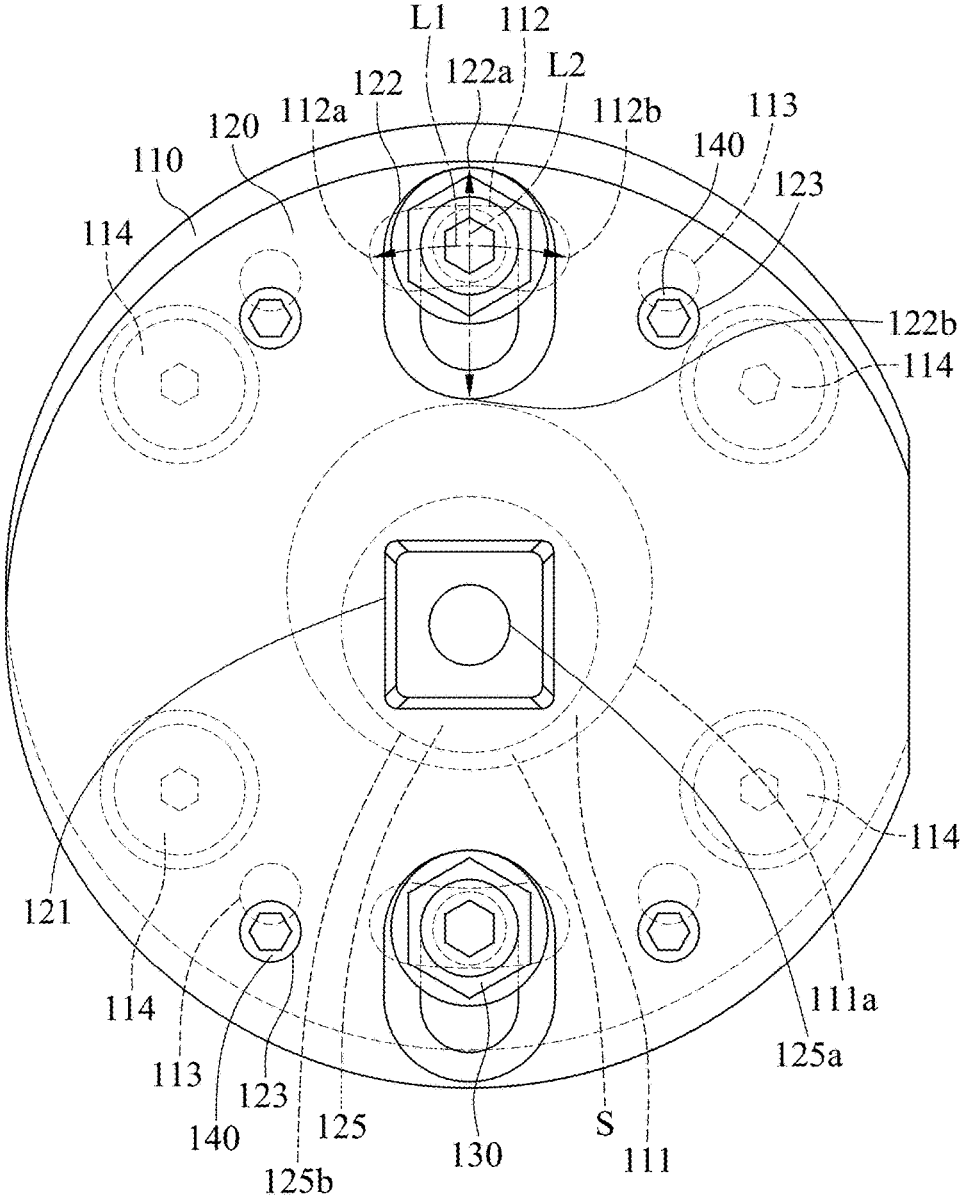

With reference to FIG. 4, when intending to adjust the coupling position of the adjusting plate 120 relative to the base 110, the installer needs to loosen the fixing element 130 in the base 110 and the adjusting plate 120 firstly to allow the adjusting plate 120 to move or rotate relative to the base 110. With reference to FIGS. 5 and 9, next, the installer can rotate the adjusting plate 120 to a predetermined angle and move the fixing element 130 from a first position (please referring to FIG. 5) to a second position (please referring to FIG. 9) along the first horizontal moving path L1. The adjusting plate 120 in rotation is capable of driving the rotating shall 220 and the cam 230 to rotate to the same predetermined angle simultaneously. With reference to FIGS. 5 and 10, on the other hand, the installer also can move the adjusting plate 120 and move the fixing element 130 from the first position (please referring to FIG. 5) to a third position (please referring to FIG. 10) along the second horizontal moving path L2. During moving the adjusting plate 120, the rotating shaft 220 is capable of being driven to move by the adjusting plate 120. With reference to FIG. 4, then the installer can utilize the fixing element 130 to fix the adjusting plate 120 on the base 110. While the door 300 is closing, the door closer 200 can allow the door 300 to swing to the predetermined closed position (please referring to FIGS. 7 and 8) by the first roller 214 or the second roller 242 which contacts with the cam 230.

Figure 11:
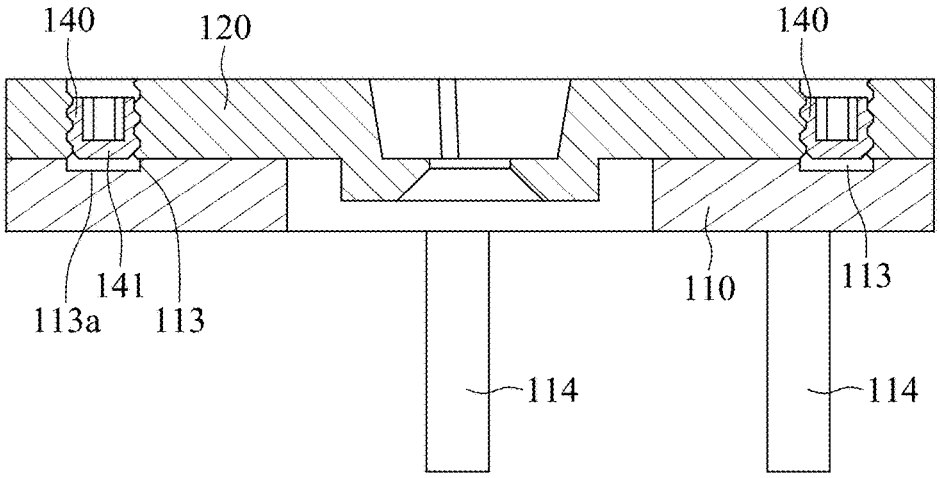
FIG. 11 is a cross-section view diagram along A-A line in FIG. 5.

With reference to FIGS. 2, 5 and 11, in the first embodiment, the adjustment mechanism 100 further includes a plurality of adjusting screws 140, and the adjusting plate 120 includes a plurality of tapped holes 123 which reveal the base 110. Each of the adjusting screws 140 is disposed in and engages with each of the tapped holes 123 respectively, and a terminal part 141 of each of the adjusting screws 140 is provided for contacting with the base 110.

Figure 12:
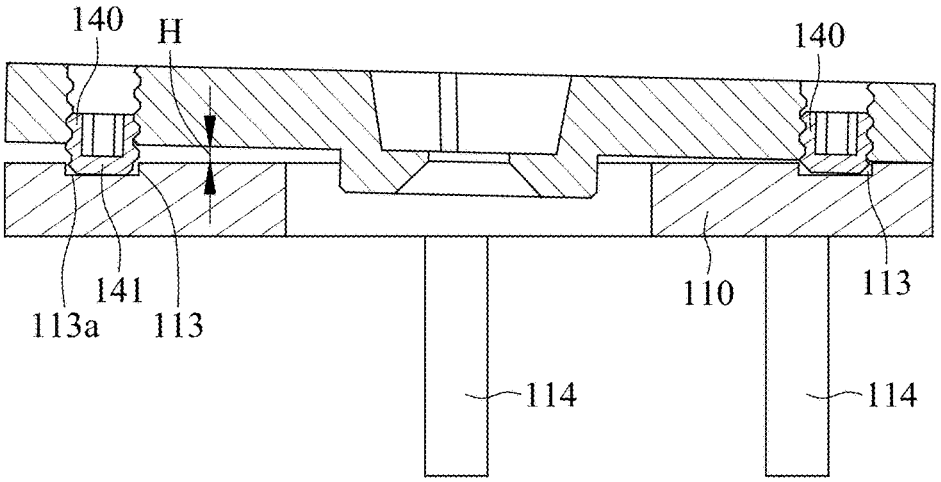
FIG. 12 is a cross-section view diagram illustrating the adjustment mechanism in accordance with the first embodiment of the present invention.

With reference to FIGS. 11 and 12, the installer can screw the adjusting screws 140 into the tapped holes 123 to contact with the base 110 for correcting the adjusting plate 120 and the door closer 200 when the door 300 is skew. For this reason, the door 300 can move back to the predetermined closed position.

With reference to FIGS. 11 and 12, when intending to adjust the adjusting screws 140, the installer can screw the adjusting screws 140 to allow the terminal part 141 of each of the adjusting screws 140 to contact with the base 110 and push up the adjusting plate 120, so as a gap H can be formed between the base 110 and the adjusting plate 120, and the door 300 is allowed to move back to the predetermined closed position.

With reference to FIGS. 2, 11 and 12, there are a plurality of grooves 113 on the base 110 in the first embodiment, and the terminal part 141 of each of the adjusting screws 140 is located in each of the grooves 113. Before moving or rotating the adjusting plate 120, the terminal part 141 of each of the adjusting screws 140 is capable of contacting with a groove bottom surface 113*a* of each of the grooves 113 to lift the adjusting plate 120. And after moving or rotating the adjusting plate 120, the terminal part 141 of each of the adjusting screws 140 is capable of contacting with the base 110 to lift the adjusting plate 120.

Figure 13:
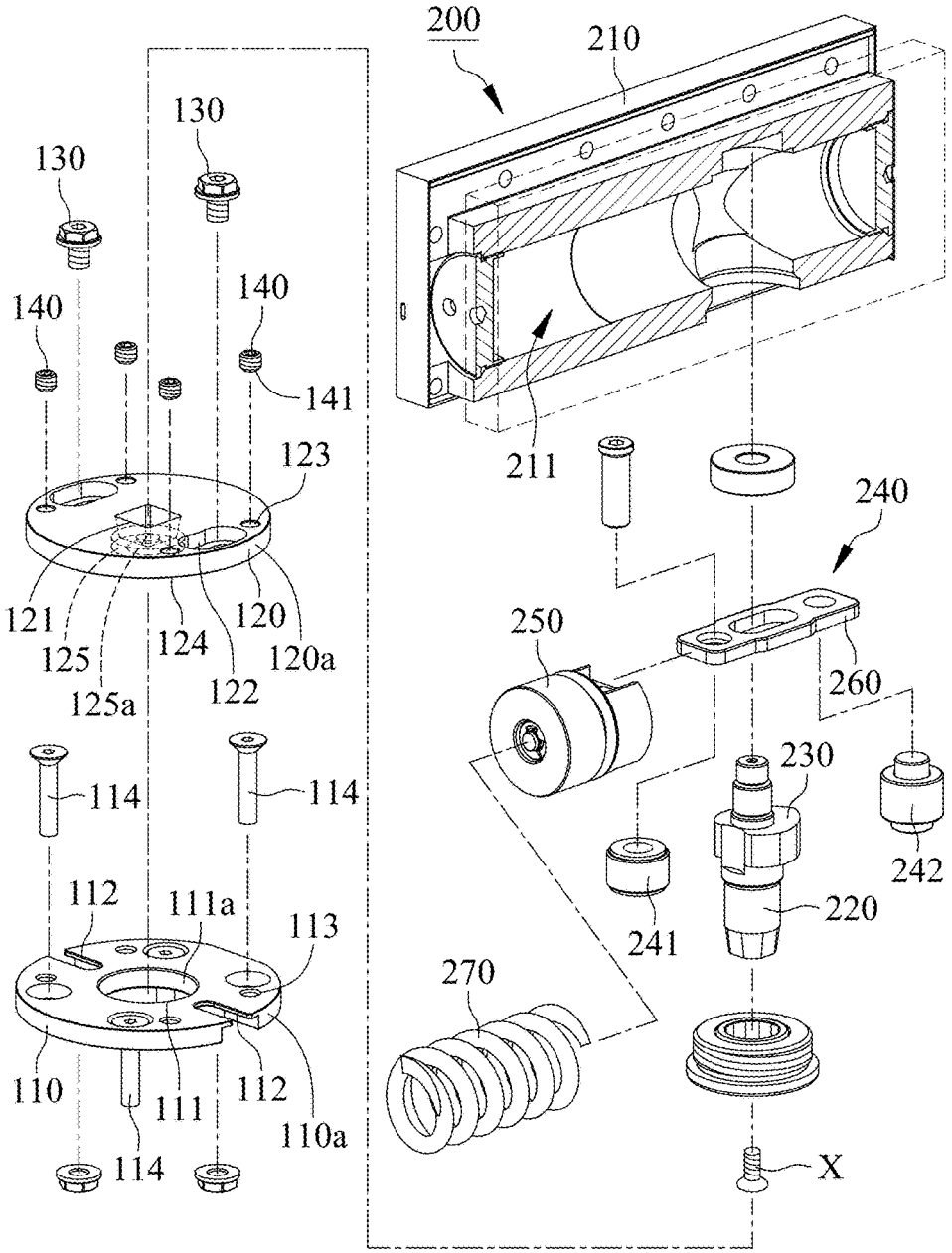
FIG. 13 is a perspective exploded diagram illustrating a door closer device in accordance with a second embodiment of the present invention.

A second embodiment of the present invention is illustrated in FIG. 13, the difference between FIG. 13 and FIG. 2 (the first embodiment) is that the first adjusting bore 112 of the base 110 is a long counterbore and the second adjusting bore 122 of the adjusting plate 120 is a curved counterbore. And there is a linear path along the long counterbore, and there is a curved path along the curved counterbore. The adjusting plate 120 is stacked with the base 110, and the fixing element 130 is disposed in the first adjusting bore 112 and the second adjusting bore 122. After adjusting the coupling position of the adjusting plate 120 relative to the base 110, the fixing element 130 is capable of coupling the base 110 and the adjusting plate 120 to allow the door 300 to swing to a predetermined closed position precisely. With reference to FIG. 12, the gap H between the base 110 and the adjusting plate 120 also can be formed by using the adjusting screws 140 in the second embodiment, hence the adjustment mechanism 100 of the present invention can correct 3D displacement of the door 300.

With reference to FIGS. 14 to 23, a door closer device in accordance with a third embodiment of the present invention comprises an adjustment mechanism 100 and a door closer 200, wherein the door closer 200 is mounted on the adjustment mechanism 100 and integrated with a door 300 to allow the door 300 to swing to a predetermined closed position.

With reference to FIGS. 14 to 17, the adjustment mechanism 100 includes a base 110, an adjusting plate 120 stacked with the base 110 and at least one fixing element 130, wherein the adjusting plate 120 and the base 110 respectively include at least one adjusting bore, and the adjusting bores of the adjusting plate 120 and the base 110 are corresponding with each other. A rotating shaft 220 of the door closer 200 is integrated with the adjusting plate 120, wherein the adjusting plate 120 includes an axial bore 121 for integrating with the shaft 220 in the third embodiment. When the door 300 is incapable of swinging to the predetermined closed position, the installer can adjust the coupling position of the adjusting plate 120 relative to the base 110 to allow the door 300 to move to the predetermined closed position.

Figure 14:
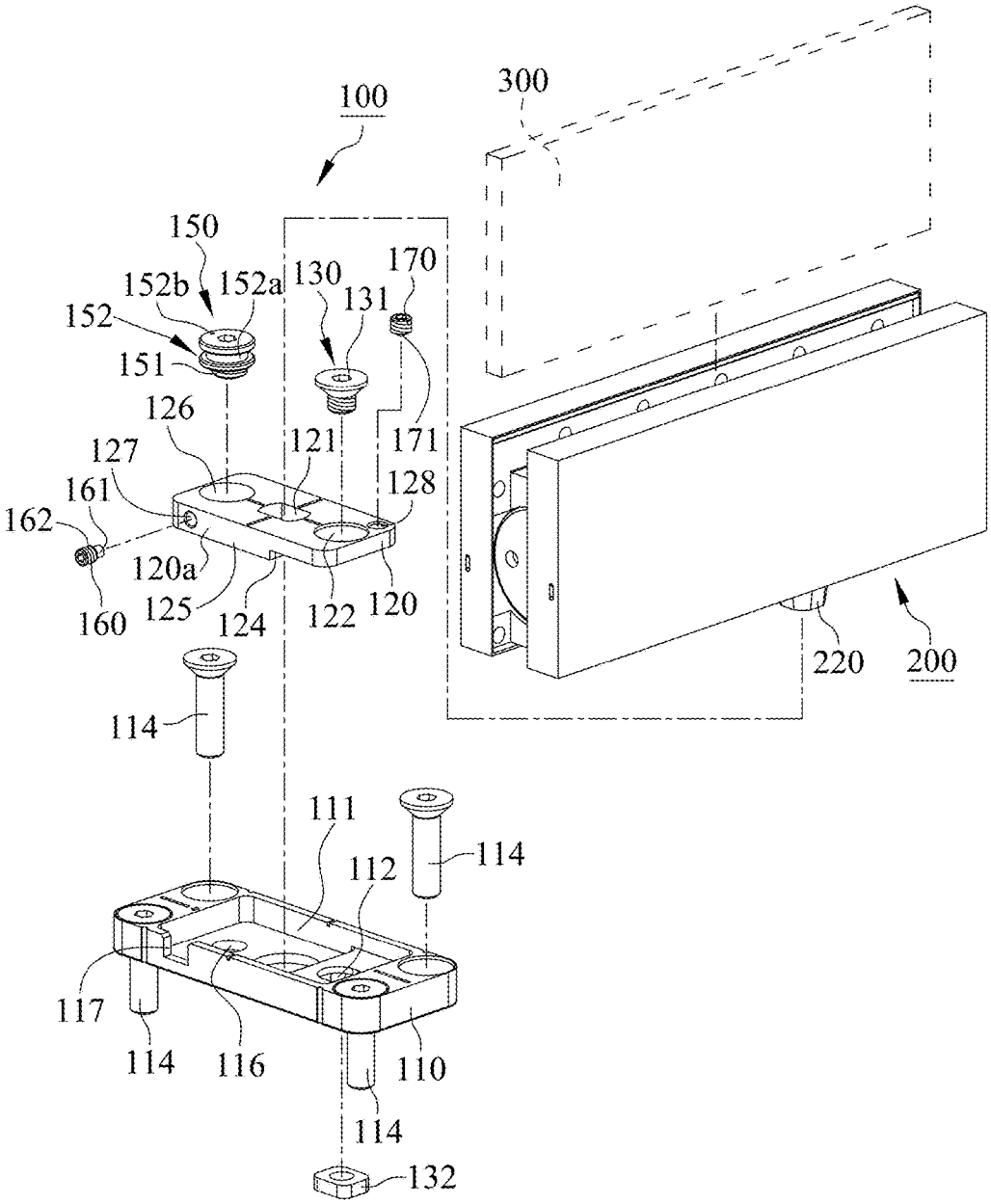
FIG. 14 is a perspective exploded diagram illustrating a door closer device in accordance with a third embodiment of the present invention.
Figure 15:
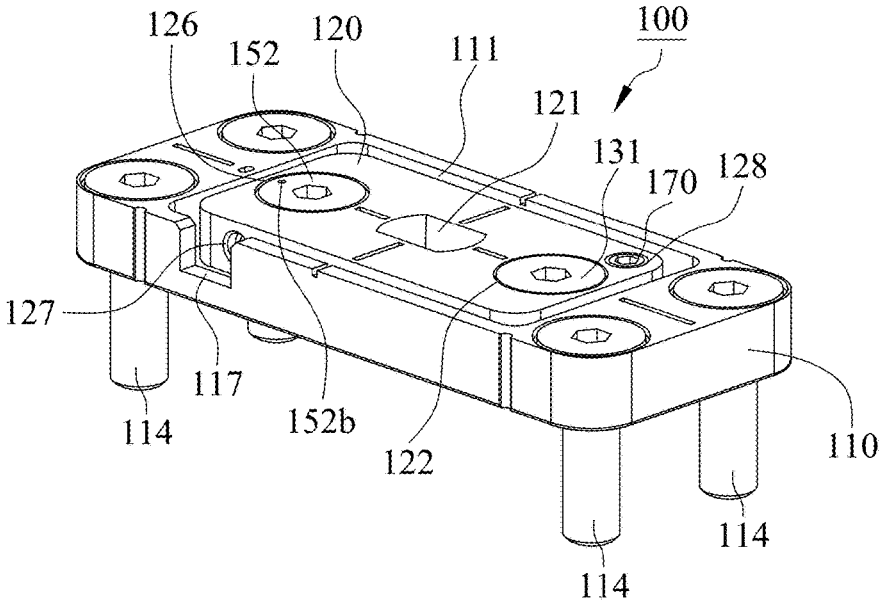
FIG. 15 is a perspective assembly diagram illustrating an adjustment mechanism of the door closer device in accordance with the third embodiment of the present invention.
Figure 16:
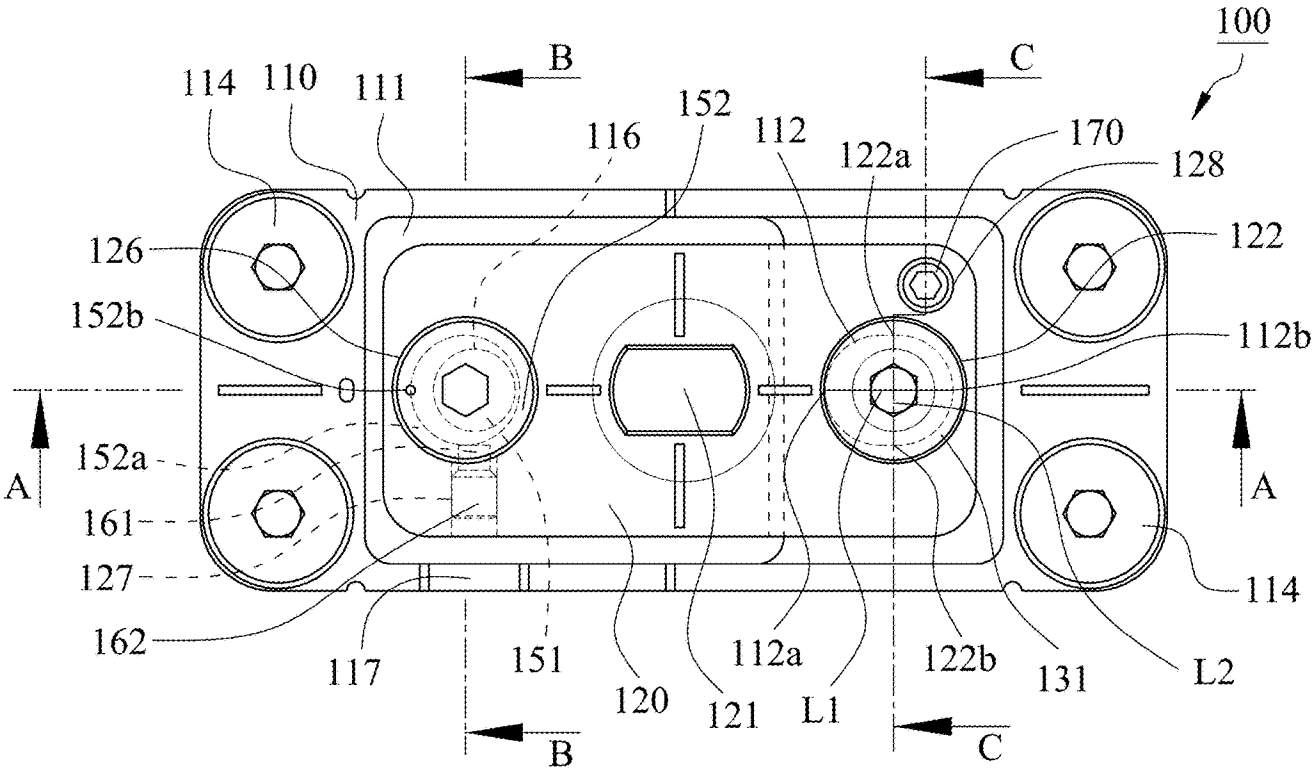
FIG. 16 is a top view diagram illustrating the adjustment mechanism of the door closer device in accordance with the third embodiment of the present invention.
Figure 17:
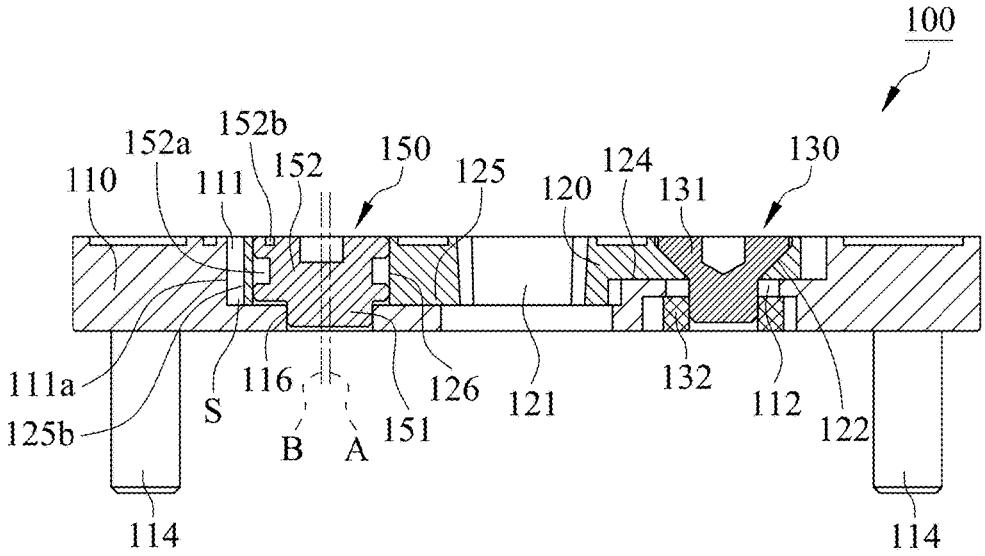
FIG. 17 is a cross-section view diagram along A-A line in FIG. 16.
Figure 18:
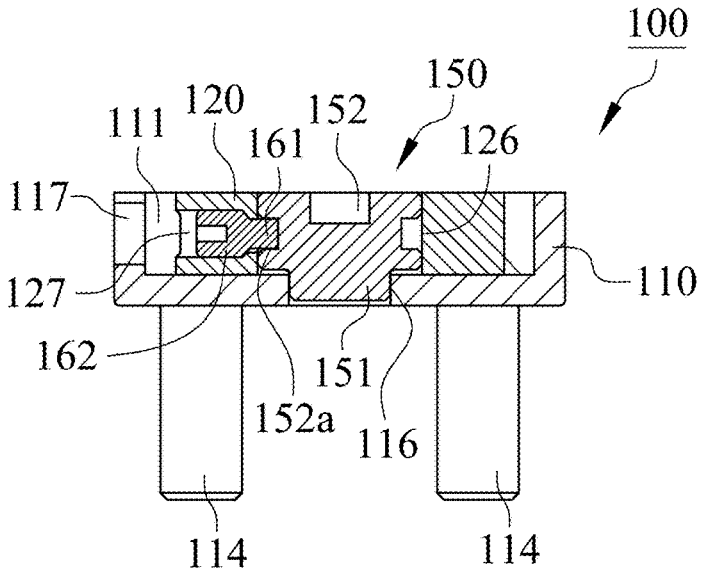
FIG. 18 is a cross-section view diagram along B-B line in FIG. 16.
Figure 20:
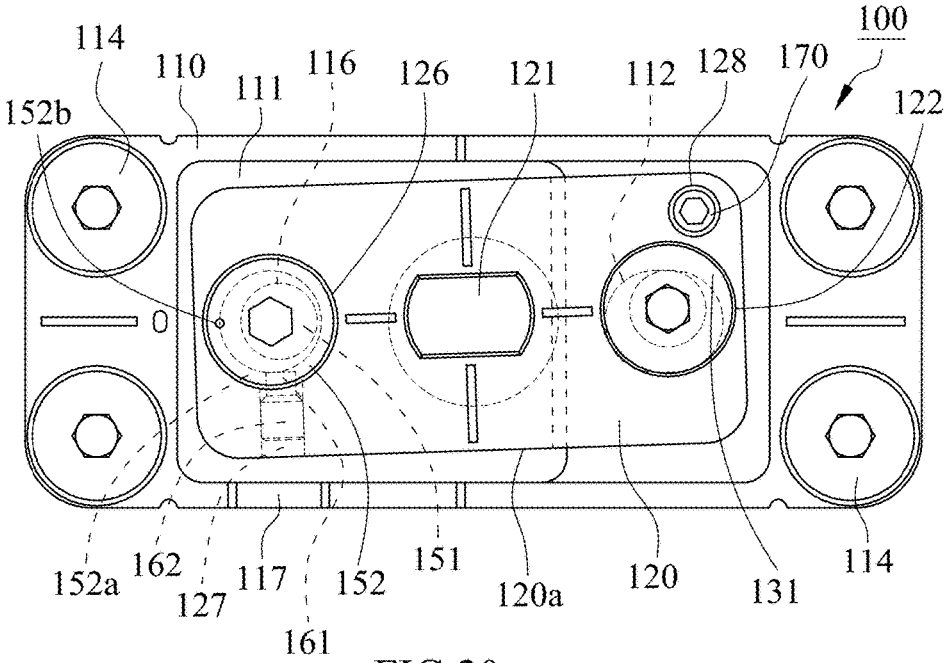
FIGS. 20 to 23 are cross-section view diagrams illustrating an adjusting plate of the adjusting mechanism adjusted to a coupling position relative to a base of the adjustment mechanism in accordance with the third embodiment of the present invention.
Figure 21:
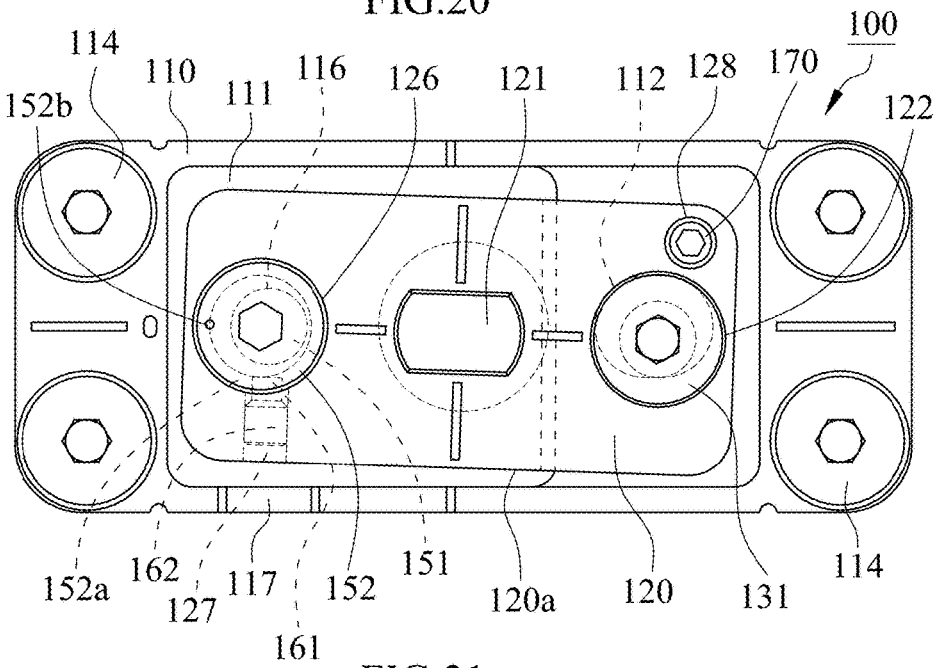

With reference to FIGS. 14 to 18, the base 110 includes a first adjusting bore 112 and a first joint bore 116, and the adjusting plate 120 includes a second adjusting bore 122 and a second joint bore 126, wherein the first adjusting bore 112 and the second adjusting bore 122 are corresponding with each other, and both are counterbores, and wherein the fixing element 130 is disposed in the first adjusting bore 112 and the second adjusting bore 122. The adjustment mechanism 100 further includes a joint element 150 disposed in the first joint bore 116 and the second joint bore 126, wherein the joint element 150 includes a first joint portion 151 and a second joint portion 152. With reference to FIGS. 17 and 18, the first joint portion 151 and the second joint portion 152 are pivotally disposed in the first joint bore 116 and the second joint bore 126 respectively, wherein the adjusting plate 120 can be selectively rotated, moved or shifted by the joint element 150 and/or the fixing element 130. With reference to FIG. 16, the first adjusting bore 112 preferably includes at least one first limiting end 112*a* and at least one second limiting end 112*b*, wherein a first horizontal moving path L1 is defined between the first limiting end 112*a* and the second limiting end 112*b*. With reference to FIGS. 16, 20 and 21, when intending to adjust the coupling position of the adjusting plate 120 relative to the base 110, the installer can rotate the adjusting plate 120 to a predetermined angle and move the fixing element 130 along the first horizontal moving path L1 to fix the adjusting plate 120 on the base 110.

With reference to FIGS. 14 to 22, the fixing element 130 disposed in the first adjusting bore 112 and the second adjusting bore 122 is capable of coupling adjusting plate 120 and the base 110 after rotating the adjusting plate 120 to a coupling position relative to the base 110. In the third embodiment, the fixing element 130 is composed of a screw 131 and a nut 132 which can engage with each other, and the external diameter of the screw 131 is shorter than the length of the first horizontal moving path L1.

With reference to FIGS. 14, 15, 16 and 18, the adjustment mechanism 100 further includes a coupling element 160 which is utilized for coupling the adjusting plate 120 and the joint element 150. With reference to FIGS. 14, 16, 18, 20 and 21, the adjusting plate 120 includes a through hole 127 in the third embodiment, wherein the through hole 127 intercommunicates with an external edge 120*a* of the adjusting plate 120 and the second joint bore 126. The coupling element 160 is disposed in the through hole 127 and contacts with the second joint portion 152 of the joint element 150, wherein the through hole 127 and the coupling element 160 are capable of a tapped hole and a screw respectively. Preferably, the second joint portion 152 of the joint element 150 includes a groove 152*a* corresponding to the through hole 127, and the groove 152*a* on the second joint portion 152 is a ring groove in the third embodiment. The coupling element 160 includes a front terminal part 161 and a rear terminal part 162, wherein the front terminal part 161 is located in the groove 152*a* and contacts with the second joint portion 152 of the joint element 150, and the rear terminal part 162 is located in the through hole 127.

With reference to FIGS. 14, 15, 16 and 18, the base 110 includes an accommodation part 111 in the third embodiment, wherein the adjusting plate 120 is disposed in the accommodation part 111. Preferably, the base 110 further includes a opening 117 which communicates with the accommodation part 111 and reveals the through hole 127, wherein the opening 117 is provided for a tool (not shown) to selectively allow the coupling element 160 to contact with or not contact with the second joint portion 152 of the joint element 150. When the coupling element 160 contacts with the second joint portion 152, it is capable of preventing the joint element 150 from rotating.

With reference to FIGS. 14, 16 and 17, in the third embodiment, a first vertical central axis A passing through the center of the first joint portion 151 and a second vertical central axis B passing through the center of the second joint portion 152 are not the same axis, that is to say the first joint portion 151 and the second joint portion 152 are eccentric. Preferably, there is a mark 152*b* formed on the second joint portion 152.

Figure 22:
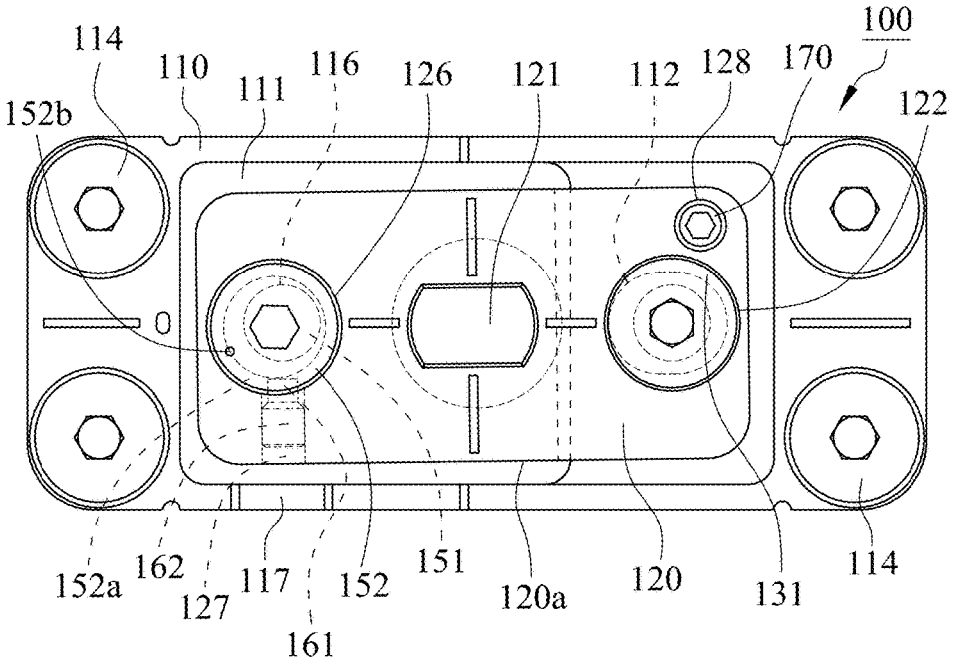
Figure 23:
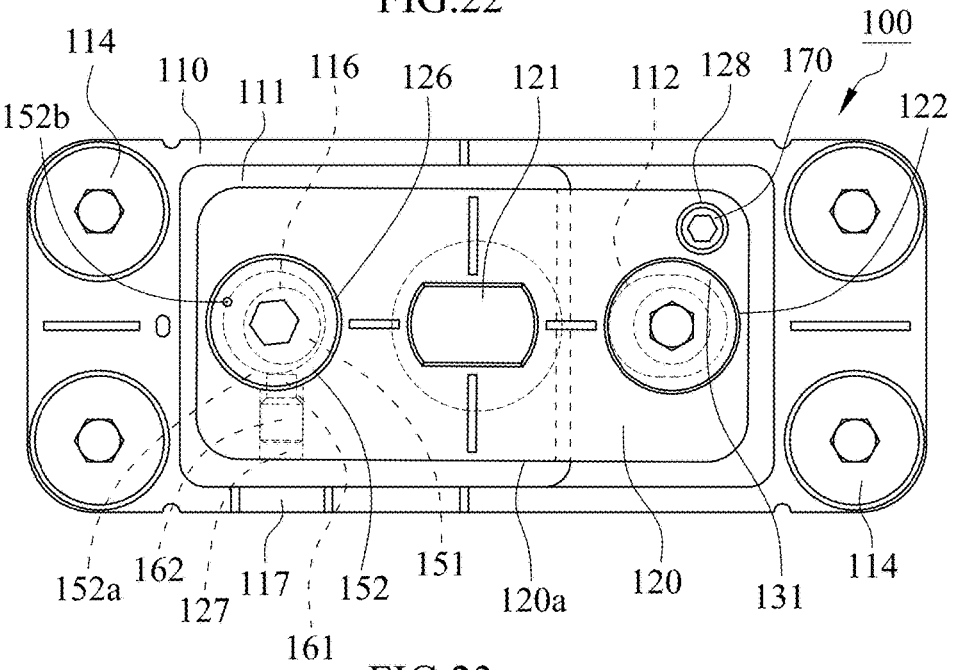

With reference to FIGS. 15 and 16, the front terminal part 161 of the coupling element 160 is firstly allowed to not contact with the second joint portion 152 while adjusting the coupling position of the adjusting plate 120 is required. With reference to FIG. 22 or 23, next, the second joint portion 152 is rotated by a tool (not shown) to allow the joint element 150 to pivot around the first joint portion 151. Owing to the first joint portion 151 and the second joint portion 152 are eccentric, and the second joint portion 152 is restricted within the second bore 126, the second joint portion 152 in rotation is capable of pushing the adjusting plate 120 to shift or move. Furthermore, the displacement of the mark 152*b* can be used to determine the shift angle and direction of the adjusting plate 120. After that, the front terminal part 161 of the coupling element 160 is capable of contacting with the second joint portion 152 to couple the adjusting plate 120 and the joint element 150, and the fixing element 130 disposed in the first adjusting bore 112 and the second adjusting bore 122 is capable of coupling the adjusting plate 120 and the base 110.

Figure 19:
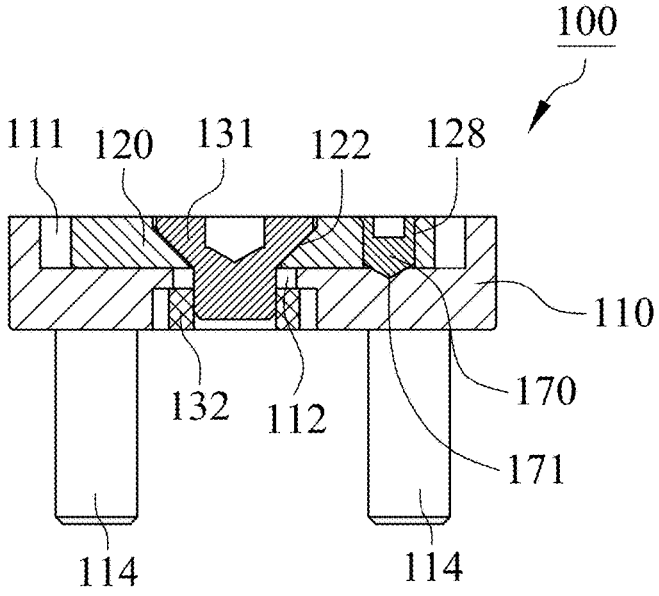
FIG. 19 is a cross-section view diagram along C-C line in FIG. 16.

With reference to FIGS. 14, 15, 16 and 19, the adjusting plate 120 includes a positioning hole 128 which can be a tapped hole, and the adjustment mechanism 100 further includes a positioning element 170 which can be a screw, wherein the positioning element 170 is disposed in the positioning hole 128. After adjusting the coupling position of the adjusting plate 120 relative to the base 110, a tool (not shown) is utilized to drive the positioning element 170 to allow a front terminal part 171 of the positioning element 170 to contact with the base 110. With reference to FIG. 19, the hardness of the positioning element 170 is preferably higher than that of the base 110, so as the front terminal part 171 of the positioning element 170 is capable of inserting into the base 110 for preventing the adjusting plate 120 from shifting or moving.

With reference to FIGS. 11 and 12, preferably, the adjustment mechanism 100 also includes a plurality of adjusting screws 140 and the adjusting plate 120 also includes a plurality of tapped holes 123 in the third embodiment, which is same with the first embodiment. The gap H can be formed between the adjusting plate 120 and the base 110 by the adjusting screws 140, hence the third embodiment also can correct 3D displacement of the door 300.

While this invention has been particularly illustrated and described in detail with respect to the preferred embodiments thereof, it will be clearly understood by those skilled in the art that is not limited to the specific features shown and described and various modified and changed in form and details may be made without departing from the spirit and scope of this invention.

What is claimed is:

1. A door closer device comprising:

a door closer including a rotating shaft; and an adjustment mechanism including:

a base including an accommodation part and a first adjusting bore with a first limiting end and a second limiting end, wherein a first moving path is defined between the first and second limiting ends;

an adjusting plate stacked with the base and including:

an axial bore aligned with the accommodation part, wherein the rotating shaft is coupled to the axial bore;

a second adjusting bore corresponding with the first adjusting bore of the base and including a third limiting end and a fourth limiting end, wherein a second moving path, perpendicular to the first moving path, is defined between the third and fourth limiting ends;

a surface facing the base; and a fixing base protruding from the surface and disposed in the accommodation part such that a space is defined between an internal side surface of the accommodation part and an external side surface of the fixing base; and a fixing element disposed in the first and second adjusting bores and movable along the first or second moving path to fix the adjusting plate on the base.

2. The door closer device in accordance with claim 1, wherein the base further includes a first joint bore and the adjusting plate further includes a second joint bore and the first and second joint bores correspond with each other, and wherein a joint element is disposed in the first and second joint bores.

3. The door closer device in accordance with claim 2, wherein the joint element includes a first joint portion and a second joint portion, and the first and second joint portions are eccentric.

4. The adjustment mechanism of door closer device in accordance with claim 3, wherein the adjustment mechanism further includes a coupling element disposed in a through hole of the adjusting plate contacting the second joint portion.

5. The door closer device in accordance with claim 4, wherein the base further includes an opening communicating with the accommodation part and wherein the adjusting plate is located in the accommodation part and the opening reveals the through hole.

6. The door closer device in accordance with claim 1, wherein the adjustment mechanism further includes a positioning element, the adjusting plate further includes a positioning hole, the positioning element is disposed in the positioning hole, and a front terminal part of the positioning element contacts the base.

7. The door closer device in accordance with claim 1, wherein the door closer further includes a case, a cam, a roller group and a piston, the cam, the roller group and the piston are disposed within an accommodation space of the case, the cam is located on the rotating shaft, the roller group has a first roller and a second roller located on both sides of the cam, respectively, and the first roller is coupled with the piston.

* * * * *